US005181794A

United States Patent [19]

Wilson et al.

[11] Patent Number: 5,181,794

[45] Date of Patent: Jan. 26, 1993

[54] REMOVABLE BARRIER

[75] Inventors: James B. S. Wilson, Vermont; Peter M. Serle, Mount Waverley; Zdenek Siroky, Hampton, all of Australia

[73] Assignee: Roads Corporation, Victoria, Australia

[21] Appl. No.: 639,803

[22] Filed: Jan. 10, 1991

[30] Foreign Application Priority Data

Jan. 18, 1990 [AU] Australia ..... PJ8229

[51] Int. Cl.[5] ..... E01F 13/00

[52] U.S. Cl. ..... 404/6; 49/49

[58] Field of Search ..... 404/6, 10; 256/1, 13.1; 49/49, 116, 370

[56] References Cited

U.S. PATENT DOCUMENTS

| | | | |
|---|---|---|---|
| 4,322,914 | 4/1982 | McGaughey | 49/370 |
| 4,475,313 | 10/1984 | Governale | 49/370 |
| 4,576,509 | 3/1986 | Beaty, Sr. | 406/6 |
| 4,624,601 | 11/1986 | Quittner | 404/6 X |
| 4,893,119 | 1/1990 | Nasatka | 49/49 X |
| 4,989,835 | 2/1991 | Hirsh | 256/13.1 |
| 5,009,542 | 4/1991 | Hardin, Jr. | 404/6 |

FOREIGN PATENT DOCUMENTS 2838637 4/1979 Fed. Rep. of Germany .

OTHER PUBLICATIONS

"Guide For Selecting, Locating, And Designing Traffic Barriers", American Association of State Highway and Transportation Officials, p. 96 (1977).

"Roadside Design Guide", pp. 6-11.

Drawing labelled "Movable Steel Barrier Typical Arrangement".

Pages 6-10 and 6-11 of a design specification for a guard rail assembly.

*Primary Examiner*—William P. Neuder

*Attorney, Agent, or Firm*—Buchanan Ingersoll; Michael L. Dever

[57] ABSTRACT

A removable barrier adapted to co-operate with a concrete median barrier of a roadway to form, in situ, a barrier between a vehicle travelling in one direction on the roadway and a vehicle travelling in another direction, wherein:

the removable barrier is adapted for movement such that, when desirable, the vehicle travelling in the one direction can transgress the barrier and travel on the opposite side of the roadway, and further wherein the removable barrier comprises at least one shell conforming substantially to the outer shape of the concrete median barrier and is adapted for sliding movement relative to the concrete median barrier.

15 Claims, 3 Drawing Sheets

2
1
3
GATE
EMERGENCY
Out Bound Traffic
City Bound Traffic

REMOVABLE BARRIER

FIELD OF THE INVENTION

The present invention relates to the field of median barriers for roadways. In particular, the present invention relates to a fixed median barrier having therein a removable barrier to enable traffic moving in one direction to exit from the lane of travel into a second lane, usually designated for traffic travelling in an opposition direction.

PRIOR ART

When a traffic blockage or accident occurs on a roadway, or when otherwise necessary, fixed median barriers do not allow traffic to bypass the blockage or accident.

Generally median barriers between a two carriage roadway is designed so that if a vehicle leaves one carriageway, either because of driver error or vehicle breakdown, the vehicle will be redirected back towards its own carriageway rather than directly into the path of oncoming traffic on the other carriageway. Conventionally such median barriers have been formed by heavy gauge corrugated metal supported by posts or by concrete blocks, the concrete blocks having a concave surface facing each carriageway and tapering in cross-section towards its upper face. It has been found that to provide a simple opening along a length of the median barrier is extremely dangerous in that catastrophic accidents can occur if a vehicle crashes into either end of the open zone of the barrier.

Various barriers for roadways have hitherto been proposed, including U.S. Pat. No. 4,576,509 which discloses a crash resistant removable barrier adapted to sit laterally across a roadway. The barrier can be opened to pass traffic and closed to bar passage of traffic. The barrier is useful as a control gate to pass authorized vehicles, and form an obstacle to unauthorized vehicles The barrier disclosed is quite bulky, cumbersome and considered unsuitable for operation as a median barrier of a roadway.

OBJECTS OF INVENTION

An object of the present invention is to provide a removable barrier for a roadway adapted to allow traffic to bypass a blockage or accident on a roadway.

A further preferred objective of the present invention is to provide a movable barrier adapted to form a gateway through a median barrier when open but which will form a practical extension of the barrier on either side of the gateway when in its closed position.

SUMMARY OF INVENTION

The present invention provides a removable barrier adapted to co-operate with a median barrier of a roadway to form, in situ, a barrier between traffic travelling in one direction and traffic travelling in another direction, wherein said removable barrier is further adapted to be moved such that, when desired, the traffic travelling in one direction is allowed to pass through and travel on the roadway where normally traffic would travel in another direction.

The present invention also provides a removable barrier adapted to co-operate with a concrete median barrier of a roadway to form, in situ, a barrier between a vehicle travelling in one direction on the roadway and a vehicle travelling in another direction, wherein the, removable barrier being capable of movement such that, when desirable, the vehicle travelling in the one direction can transgress the barrier and travel on the opposite side of the roadway, and further wherein the removable barrier comprises at least one barrier conforming substantially to the outer shape of the median barrier and is adapted to slidingly move over the median barrier.

The present invention further provides a removable barrier adapted to co-operate with a median barrier dividing a roadway, the barrier forming in a first configuration a barrier between each side of the roadway, and the barrier forming in a second removed configuration a passage through the median barrier from one side to the other side of the roadway.

The removable barrier may include means to prevent forced access through the barrier.

The means to prevent forced access may include a holding means for co-operation with the removable barrier. The holding means may be slidably coupled to the removable barrier and may further provide a guide along which the removable barrier is moved from the first to the second configurations.

The base section may further provide or incorporate a cross slope drainage means.

The present invention also provides a median barrier including the removable barrier described above.

A preferred embodiment of the present invention will now be described with reference to the accompanying drawings, wherein.

Figure 1:
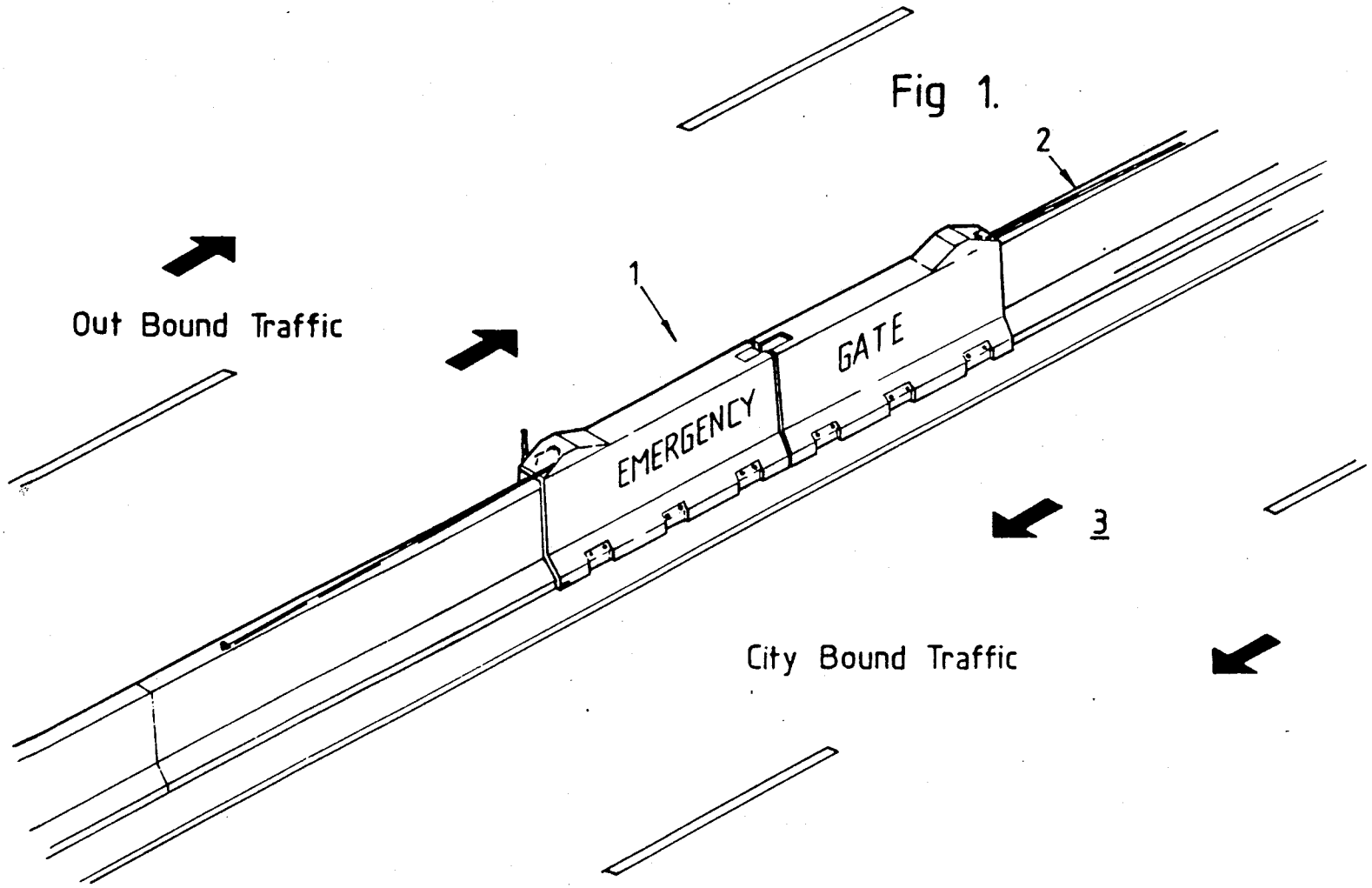
FIG. 1 shows the removable barrier of the present invention in closed position.

With reference to FIG. 1, the removable barrier 1 of the present invention is shown in association with a median barrier 2 of a roadway 3. The median barrier may be of any suitable construction, such as steel or concrete, and may also be of any suitable shape, for example as disclosed in U.S. Pat. No. 4,661,010, U.S. Pat. No. 4,806,044 and U.S. Pat. No. 4,498,803.

The removable barrier 1 may comprise of at least one shell, which preferably conforms substantially to the shape of the median barrier of the roadway.

Figure 2:
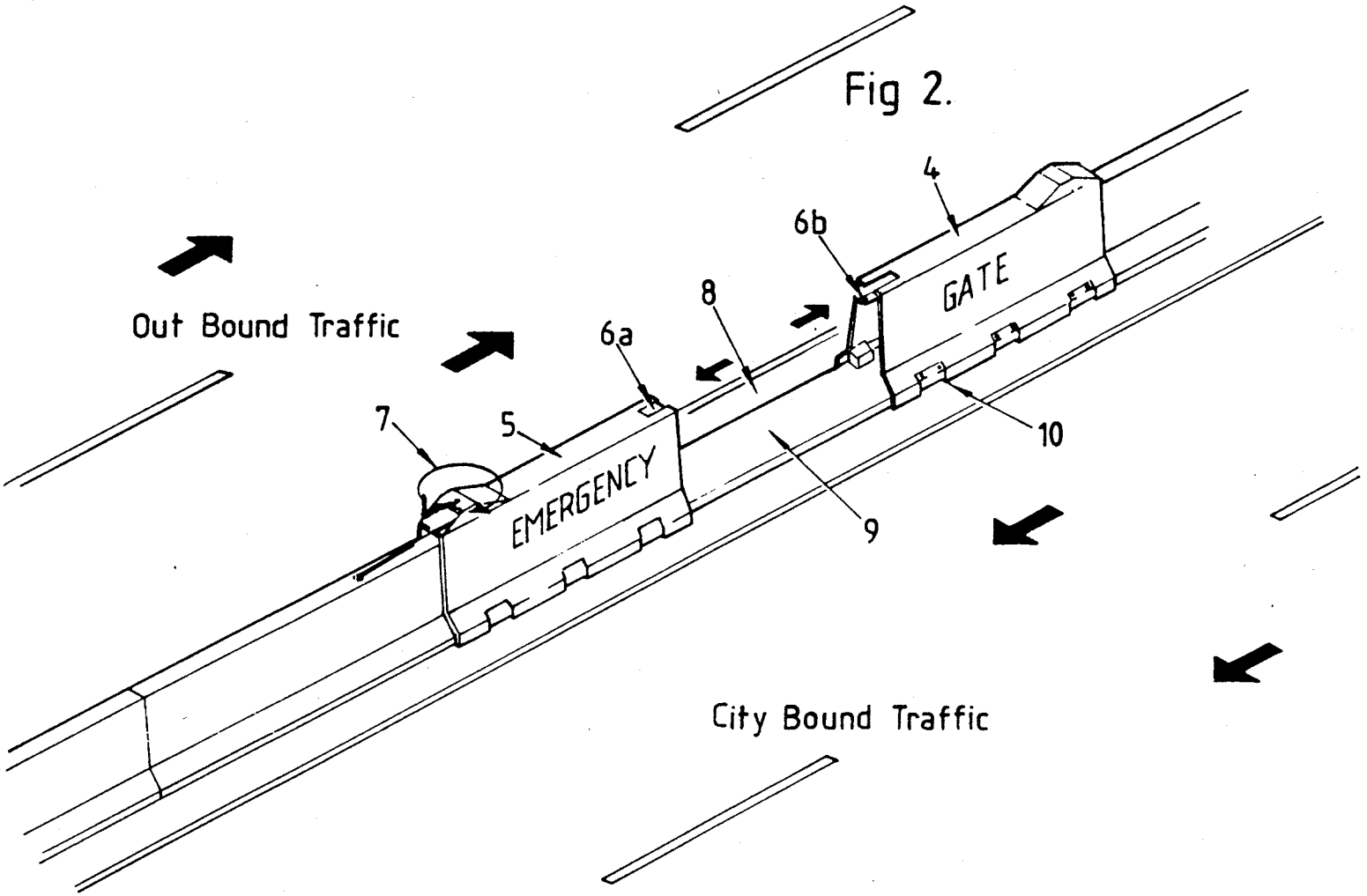
FIG. 2 shows the barrier in a partially open position.

As can be better seen with reference to FIG. 2, the preferred movable barrier shown comprises two formed shells 4, 5. Preferably, the two shells 4, 5 are of metal and shaped similar to the basic profile of the fixed median barrier 2 in order to minimize formation of a protuberance from the barrier which may be undesirable. In a closed or blocking configuration between lanes or sides of the roadway (city bound and out bound traffic), the removable barrier forms a continuance of the median barrier 2. The shells 4, 5 are locked together by suitable locking means 6*a*, 6*b* which provides extra rigidity to the removable barrier in the closed position in the event of a vehicle colliding with the barrier.

The two shells 4, 5 may also include internal bracing to minimize damage to the shells in the event of impact by a vehicle. Alternatively, the shells may include, shock or impact absorbent material to substantially absorb impact by a vehicle.

The barrier can be opened in a horizontal direction by means of a winch mechanism 7, which may be manually or drivingly operated. The barrier may alternatively be opened by other suitable means such as pneumatic or hydraulic cylinders or electric motors connected to support wheels.

The barrier may also include holding means to substantially prevent forced access through the barrier and is shown at 8. It comprises a base section which cooperates with the shells 4, 5 to allow the shells to be moved in a horizontal direction. Preferably, the holding means comprises a rail section 9 about which shell engagement means 10, in the form of wheels or rollers are adapted to move. The holding means also provides additional restraint for the barrier if and when impacted by a vehicle. The barrier may also serve to alleviate cross slope draining, which can prove to be a major hazard on roadways, by limiting the passage of water from one lane of traffic to another lane of traffic.

Figure 3:
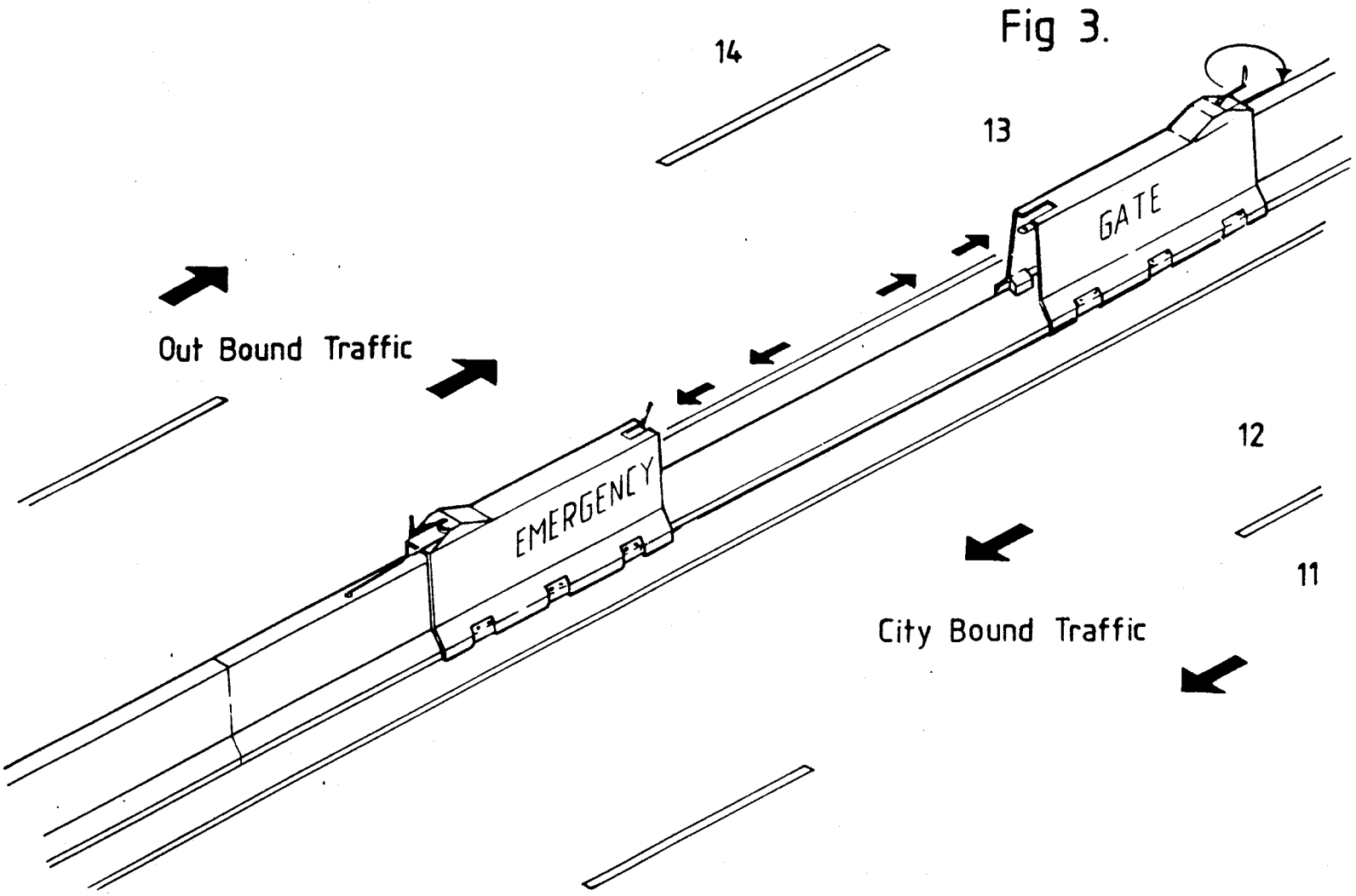
FIG. 3 shows the barrier in a substantially open position.

FIG. 3 shows the barrier in a substantially open position. In this open position vehicles in, say, the city bound lanes 11 and 12 can pass through the barrier into out bound lane 13, for temporarily travelling in a city bound direction. The vehicles having crossed through the barrier into lane 13 can pass back into lanes 11 and 12 of the roadway via another removable barrier in accordance with the present invention located further along the roadway.

Meanwhile, traffic which usually travels in an outbound direction in lane 13 must travel in lane 14 in order to avoid "head-on" collisions with the city bound traffic temporarily in lane 13. Additional temporary roadway dividers can be placed between lanes 13 and 14 interposed the two open removable barriers to prevent any such head-on collisions.

Alternatively, all vehicles from blocked lanes 11 and 12 can be directed to lanes 13 and 14 to travel in the direction which all traffic in these lanes normally travel.

Thus, the present invention serves to provide a median barrier for a roadway which is relatively easily movable to allow passage therethrough. This serves to allow traffic to bypass a blockage or accident on a roadway.

We claim:

1. A retractable barrier adapted to cooperate with an intermediate passageway in a fixed median barrier serving as a partition between a first traffic lane and a second traffic lane, said retractable barrier being adapted to move between an open position and a closed position whereby said intermediate passageway is either open to permit traffic to move through said passageway between said traffic lanes when said passageway is open or is closed to prevent traffic movement through said passageway; said retractable barrier comprising at least one movable barrier member nd fixed holding means arranged in said intermediate passageway to which said at least one barrier member is retained to resist vehicle impact when said retractable barrier is in said closed positions and acting as a guide during movement of said at least one barrier member towards said closed position.

2. The retractable carrier of claim 1, further including means for moving said at least one barrier member whereby in said open position said at least one barrier member is bodily moved free of said intermediate passageway.

3. The retractable barrier of claim 1, wherein said fixed holding means is positioned substantially at ground level and extends at least partially across said intermediate passageway.

4. The retractable barrier of claim 1, wherein said fixed holding means includes a rail section about which one of wheels and rollers of said retractable barrier are adapted to move.

5. The retractable barrier of claim 1, wherein said at least one barrier member is moved in a direction parallel to said intermediate passageway when moved to open said intermediate passageway.

6. The retractable barrier of claim 5, wherein said at least one barrier member comprises a shell with side faces arranged to move outwardly of the length of said fixed median barrier adjacent said intermediate passageway.

7. A retractable barrier adapted to cooperate with an intermediate passageway in a fixed median barrier serving as a partition between a first traffic lane and a second traffic lane, said retractable barrier being adapted to open or close the intermediate passageway to permit traffic to move through said passageway between said traffic lanes when said passageway is open; said retractable barrier comprising at least one movable barrier member formed in a shell with side faces of said shell arranged to move outwardly of and alongside of opposed side walls of said fixed median barrier when moving to open said intermediate passageway.

8. The retractable barrier of claim 7, wherein side faces of the shell of said at least on movable barrier member has a shape conforming to a profile shape of the side walls of said fixed median barrier.

9. The retractable barrier of claim 7, wherein two said movable barrier members are provided, each of said barrier members being movable in opposite directions when being positioned to open said intermediate passageway.

10. The retractable barrier of claim 7, wherein said movable barrier members include interengaging lock means when said intermediate passageway is closed to resist unauthorized movement of said barrier members to open said intermediate passageway.

11. The retractable barrier of claim 7 further including fixed holding means arranged in said intermediate passageway to which said at least one movable barrier member is retained to resist vehicle impact when said retractable barrier is closed.

12. The retractable barrier of claim 11, wherein said fixed holding means acts as a guide during meovemetn of said at least one barrier member towards said closed position.

13. The retractable barrier of claim 11 further including means for moving said at lest one barrier member whereby when said retractable barrier is open, said at least one barrier member is bodily moved free of said intermediate passageway.

14. A median barrier serving as a partition between a first traffic lena and a second traffic lane, said median barrier comprising a first fixed barrier section aligned with a second barrier section, said first and second fixed barrier sections being spaced apart by an intermediate passageway, a retractable barrier in a close position spanning said intermediate passageway and in a retracted open position being withdrawn from said intermediate passageway permitting free access therethrough between said traffic lanes, said retractable barrier comprising at least one movable member formed in a shell with side faces of said shell arranged to mvoe outwardly of an alongside of opposed side walls of at least one of said first and second fixed barrier sections when moving to said open position.

15. The median barrier of claim 14, wherein the side faces of the shell of said at least on movable barrier member has a shape conforming to a profile shape of the side walls of said first or second fixed barrier sections.

* * * * *

UNITED STATES PATENT AND TRADEMARK OFFICE

CERTIFICATE OF CORRECTION

PATENT NO. : 5,181,794

DATED : January 26, 1993

INVENTOR(S) : James B.S. Wilson, Peter M. Serle, Zdenek Siroky

It is certified that error appears in the above-identified patent and that said Letters Patent is hereby corrected as shown below:

Column 3, claim 1, line 52, change "nd" to --and--.

Column 4, line 42, claim 12, change "meovemetn" to --movement--.

Signed and Sealed this

Seventh Day of December, 1993

*Attest:*

Bruce Lehman

BRUCE LEHMAN

*Attesting Officer*

*Commissioner of Patents and Trademarks*